US005477757A

United States Patent [19]

Maresh

[11] Patent Number: 5,477,757

[45] Date of Patent: Dec. 26, 1995

[54] ERGONOMIC RATCHET WRENCH

[76] Inventor: Joseph D. Maresh, 19919 White Cloud Cir., West Linn, Oreg. 97068

[21] Appl. No.: 301,555

[22] Filed: Sep. 6, 1994

[51] Int. Cl.[6] ..... B25B 13/46

[52] U.S. Cl. ..... 81/63.2; 81/63

[58] Field of Search ..... 81/63.2, 60, 61, 81/62, 63, 63.1

[56] References Cited

U.S. PATENT DOCUMENTS

| | | | |
|---|---|---|---|
| 2,982,161 | 5/1961 | Angquist et al. | 81/60 |
| 3,044,591 | 7/1962 | Kilness | 81/63.2 |
| 4,261,233 | 4/1981 | Konecny | 81/62 |
| 4,406,186 | 9/1983 | Gummon | 81/60 |
| 4,524,652 | 6/1985 | Wenzel et al. | 81/63 |
| 4,612,830 | 9/1986 | Yang | 81/63.2 |
| 4,807,500 | 2/1989 | Main | 81/60 |
| 4,869,138 | 9/1989 | Farris | 81/63 |
| 4,903,554 | 2/1990 | Colvin | 81/63 |
| 5,000,066 | 3/1991 | Gentiluomo | 81/62 |
| 5,012,705 | 5/1991 | Chow | 81/63 |
| 5,157,994 | 10/1992 | Krivec | 81/63.2 |
| 5,174,176 | 12/1992 | Krivec | 81/63.1 |
| 5,178,047 | 1/1993 | Arnold et al. | 81/63.2 |
| 5,199,330 | 4/1993 | Arnold et al. | 81/63.2 |
| 5,231,903 | 8/1993 | Bockman, Jr. | 81/63.2 |

FOREIGN PATENT DOCUMENTS

| | | | |
|---|---|---|---|
| 2041272 | 9/1980 | United Kingdom | 81/60 |

*Primary Examiner*—Willis Little

[57] ABSTRACT

A ratcheting mechanism consisting of a ratchet housing having internal teeth, which surrounds a drive member and applies torque to a pawl mounted pivotally to said drive member, said pawl of said drive member having external teeth and being pivotable for ratcheting action against said ratchet housing internal teeth. The mechanism being reversible by the application of spring actuated force radially inward against either opposite distal end of said pawl, said spring being secured to an annularly configured control ring surrounding said drive and having means to directly engage and rotate said drive upon pawl reversal. The mechanism may be reversed and driven in either direction at any time simply by rotating the control ring in the direction desired to rotate the drive, followed by continued rotation of the control ring, or rotation of the housing member.

18 Claims, 8 Drawing Sheets

ERGONOMIC RATCHET WRENCH

BACKGROUND OF THE INVENTION

The prior art is replete with designs of ratcheting mechanisms which are incorporated in a variety of items. Perhaps the most popular item in which they are incorporated relates to the tool category, and in particular to a device known as a ratchet wrench. Ratchet wrenches are useful during such tasks as the turning nuts, bolts, screws and the like. Essentially, ratchet wrenches consist of a ratchet wheel integrated with a drive member, to which a handle integrated with a pivotal pawl member is combined. Ratchet wrenches are usually reversible, in order to change the direction to which torque may be applied. Reversibility may be achieved, dependent upon the particular tool design, by either flipping the tool over, or by causing the ratchet pawl to be reorientated such that the pawl applies torque to an opposite direction. Surprisingly, despite the multiplicity of designs, commonalities continue to exist regarding the unergonomic action required by the operator when it is desired to shift or change ratcheting directions. In describing this, I will first refer to those ratchets which utilize a control ring or reversing hub which must be rotated in order to cause the pawl to pivot or shift, thereby reversing the ratcheting direction. All such known designs require the operator to rotate the control ring, when shifting the pawl, to a direction opposite the direction desired to rotate the drive. This operational characteristic is therefore unnatural and requires a learned action by the operator. This confusion is often compounded when ratchet tools also incorporate a drive ring which may be rotated in the same direction as the drive, in order to enable the operator to rapidly spin the drive by fingers when minimal torque is required. In referring to alternate ratchet designs which utilize a lever to shift the pawl, operational confusion also exists because association between rotation direction of the drive, and directional actuation of the pawl shift lever is not intuitive. Note that many popular ratchets utilizing a lever to shift the pawl permanently label the on and off position.

The present invention departs from the previous art in both obviousness of function as well as ergonomic form. A control ring will be used to shift the pawl position, but the direction to which it must be rotated during shifting is advantageously the same direction as desired for the drive to be rotated while applying torque. Furthermore, with the present invention, if the torque required to cause rotation of the drive is minimal, the control ring may simply be continually rotated, after the pawl has shifted, to rapidly spin the drive, and thereby spin the coupled nut or bolt. The mechanism will automatically allow a transitional function of the control ring between pawl shifting and nut spinning, in either direction, at any time. Additionally, a very significant advantage of the present invention is that the ratchet may be reversed with one finger without the aid of a second hand.

BRIEF DESCRIPTION OF THE INVENTION

Describing in general the mechanics of this tool, external teeth of the pawl will engage with internal teeth of the tool drive housing. The shaft about which the pawl pivots is secured to a drive member, the drive member being the member to which interchangeable sockets and the like are attached. In order to enable the pawl, and hence the tool, to operate at any orientation, a spring is utilized to constantly bias the external teeth of the pawl against the internal teeth of the tool housing or ratchet head. Because it is desired to provide reversibility, the spring which applies force against the pawl must be allowed to move to opposite ends of the pawl, to either end away from the pawl pivot point. The pawl spring will always exert force radially inward against the pawl, and will be secured to a control ring which is designed to rotate coaxially with the axis of rotation of the drive member. In the preferred embodiment, the control ring will also secure a shift range stop element or stop peg which will protrude radially inward at a position diametrically opposite the pawl spring. The shift range stop peg will protrude into a recess or key slot within a portion of the drive member such that a sufficient range of rotation (or angular span) of the control ring is permitted in order that the pawl may be shifted, prior to abutment of the shift range stop peg against a radial side of the drive member recess. Thereafter, the control ring may be continually rotated by fingers to automatically spin the drive, assuming of course that minimal torque is experienced at the attached socket or accessory.

In the preferred embodiment, the control ring is located at the longitudinal center of the ratchet head or housing. It is fortuitous that this design will allow this, because by locating the control ring in this vicinity the pawl is supported by the drive with minimal potential for misalignment, and may be readily digitally manipulated yet be protected from metallic objects when the wrench is used within close quarters. It is not possible to locate the control ring of conventional ratchet designs in this preferred region.

Addressing now operational deficiencies of conventional ratchet designs, and in particular those which utilize a reversing hub to change ratcheting directions, further unergonomic characteristics will be noted. One of these undesirable characteristics relates to the necessity that the operator hold the driven member stationary with one hand, while the selector knob is rotated with the other hand. If the driven member is not held stationary, the selector knob will rotate the driven member without changing the direction of the ratcheting action. Also, if the operator interferes with the reversing hub while ratcheting, the pawl will be caused to either partially or fully disengage with the internal teeth of the drive housing.

In addressing deficiencies such as this, and extending the discussion to include lever actuated pawl shifting designs, a similar problem occurs if ones fingers or hand palm are in contact with the shift lever while attempting to ratchet. In this case, as the ratchet housing rotates during its back stroke, a ratcheting pivoting movement of the actuation lever occurs. This oscillating movement or wobbling of the lever could therefore inadvertently be held at some position less than optimum, resulting in potential damage to the mechanism; or be moved to a neutral position, creating hazards to the operator. There are several notable design exceptions to this with reference to lever actuated pawls, but to overcome this problem expensive and complicated designs had to be conceptualized. Two examples of such are U.S. Pat. No. 5,000,066, Gentiluomo; and U.S. Pat. No. 5,157,994, Krivec. In fairness it should be noted that with the present invention, if the operator holds the control ring in a fixedly manner with respect to the housing while attempting to ratchet back and forth, the mechanism will be caused to continually reverse, but by incorporating the control ring centrally within the housing head, as shown in the preferred embodiment, this potential operational deficiency is eliminated.

Continuing in general with the design of the present invention, additional elements are desirable to assure satisfactory operation and assembly. These are relatively minor, and will be discussed here only briefly. The first to be mentioned are what is referred to in this text as antifriction rings. These will be located between the control ring and the ratchet housing, and may be keyed into a drive recess as to frictionally isolate the control ring from the ratchet housing. This is to eliminate the possibility of the control ring being frictionally actuated by the housing during ratcheting. The antifriction rings also perform an additional function, notably in the preferred embodiment, by diametrically centralizing the control ring within the housing head, and preventing dirt or other foreign matter from entering the assembly.

The next element(s) to be mentioned are what is referred to as spacer elements or spacer pegs, and are utilized in the preferred embodiment in order to space the antifriction rings apart during ratchet assembly. The shift range stop peg, and a spring plunger sleeve housing serve dual functionality in this respect, and will be addressed in the detailed description of the parts.

The remaining elements, a retainer clip and an optional dirt or foreign matter entry prevention plug will also be addressed in greater detail later in this text.

BRIEF DESCRIPTION OF THE DRAWINGS

The invention will be further described in conjunction with the accompanying drawings, which illustrate preferred embodiments, and wherein.

DETAILED DESCRIPTION OF THE INVENTION

Figure 1:
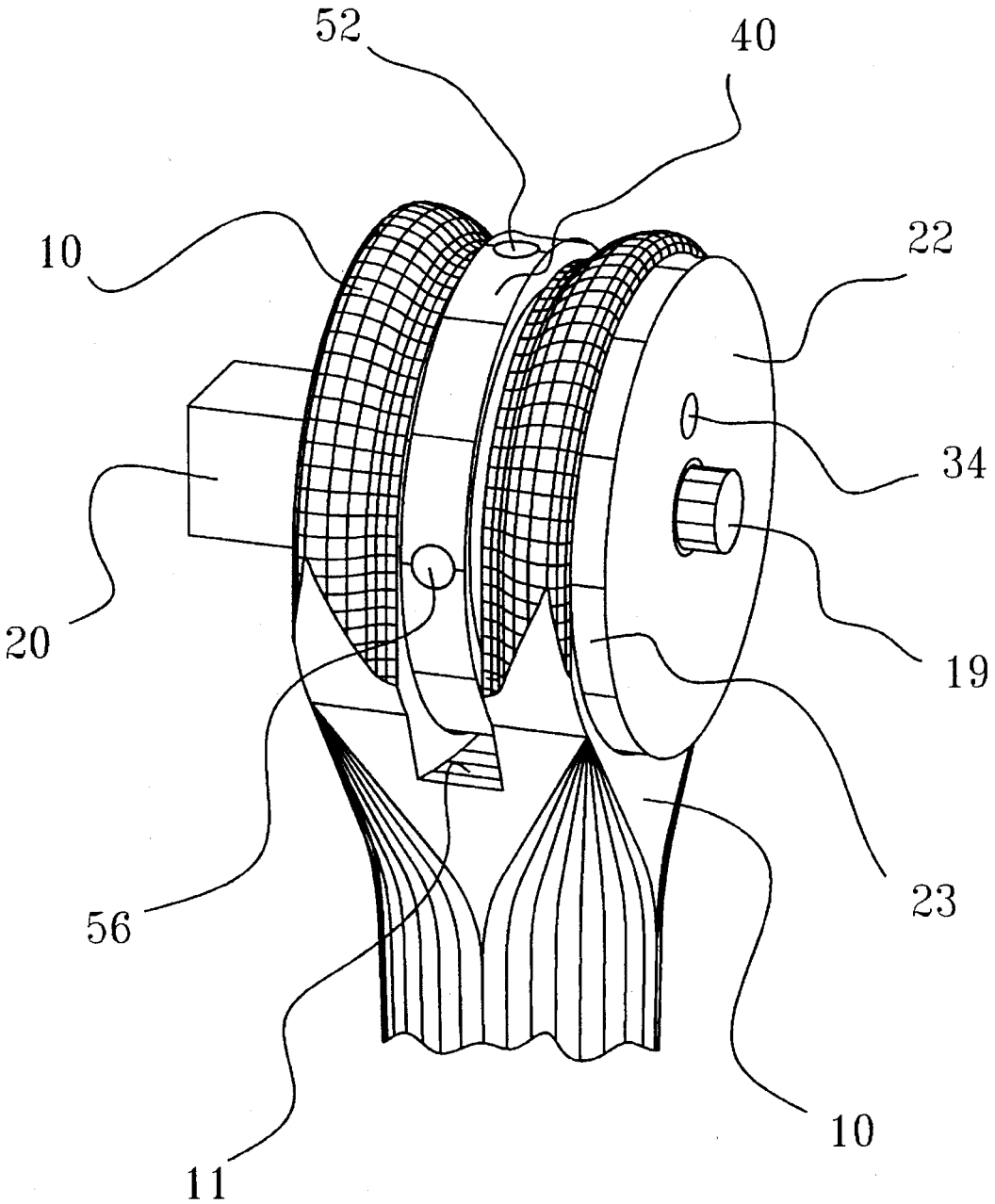
FIG. 1 is an external perspective view of the preferred embodiment.

Referring now to the figures, I have shown in FIG. 1 an enlarged perspective view of ratchet head 10 of the preferred embodiment. The square drive 20 is typically one quarter to three quarters of an inch square, and is designed to receive interchangeable sockets or accessories. The accessories to be attached will have receiving portions of female dimensions corresponding to the dimensions of the square drive. Square drive 20 shows a ball slidably located within a face or side, and is actuated outwardly to serve as a socket retention means. A conventional quick release system, with its associated cammed ball and quick release button 19 may alternatively be incorporated into the design. This quick release button is shown only in FIG. 1, and its associated functional elements are omitted in all drawings due to the common knowledge of their form or principles of operation. Continuing with FIG. 1, the drive disk 22 is integral with the square drive 20, and is provided in part to enable the operator to directly spin the attached accessory by hand. The drive disk circumference 23 may be knurled to aid in this respect. The unillustrated pawl is supported by pawl shaft 34, which is parallel to the drive member's rotational axis, and passes through its entirety. The control ring 40 is centrally located within the ratchet head 10, and shows pressed into it the pawl shift peg outer cylinder 52, and one of the spacer pegs 56. The ratchet head control ring groove bottom 11 is the result of a slice machined out of the longitudinal center of the ratchet head. Typically this would be machined with a large diameter cutting disk which would result in the groove bottom 11 being of arcuate form.

Figure 2:
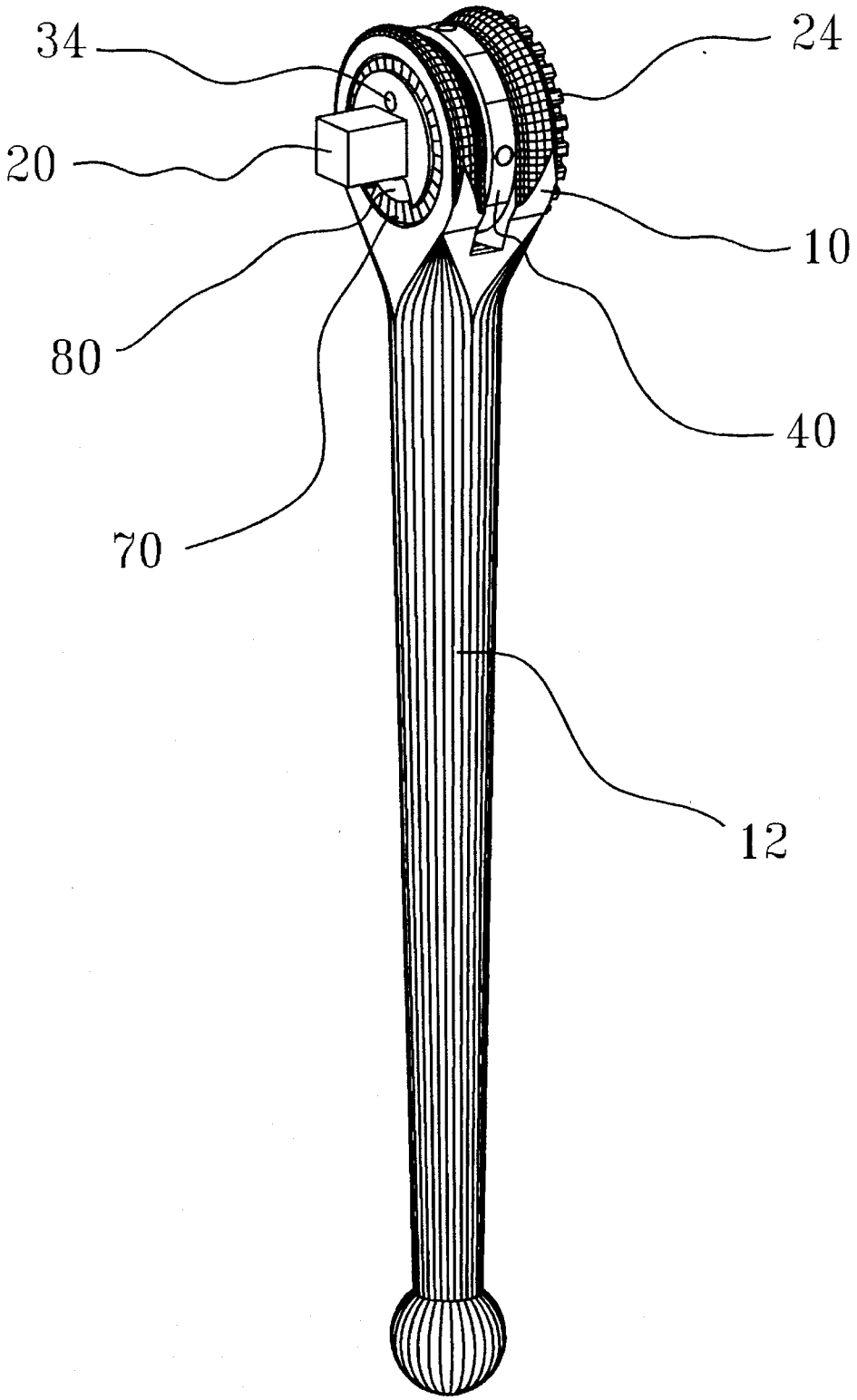
FIG. 2 is an overall perspective view of the preferred embodiment.

Directing attention now to FIG. 2, a perspective view is shown of the complete tool where the square drive 20 is directed at an angle toward the reader. This figure reveals the pawl shaft 34 as it has extended throughout the drive's entirety. This pawl shaft 34 may be press fit into the drive, and loose fit to the pawl. The assembly retaining clip 70 may be of conventional internal design, or as shown here, may be of light, flexible spring steel helically formed and typically known as a spiral retaining ring. Plug 80, of molded synthetic or rubber material, may be inserted before the assembly retaining clip 70 is installed, and is provided to prevent dirt or other foreign substances from entering the mechanism. The optionally knurled drive disk 24 is integral with the drive, and as indicated earlier, may be provided to aid during drive spinning. Control ring 40 may also be knurled to aid during finger actuation, but is shown in all drawings as consisting of a smooth contour. The ratchet handle 12, connected to ratchet head 10, is proportioned in length to the size of the square drive 20 such that mechanical limits of the mechanism are not likely to be exceeded.

Figure 3:
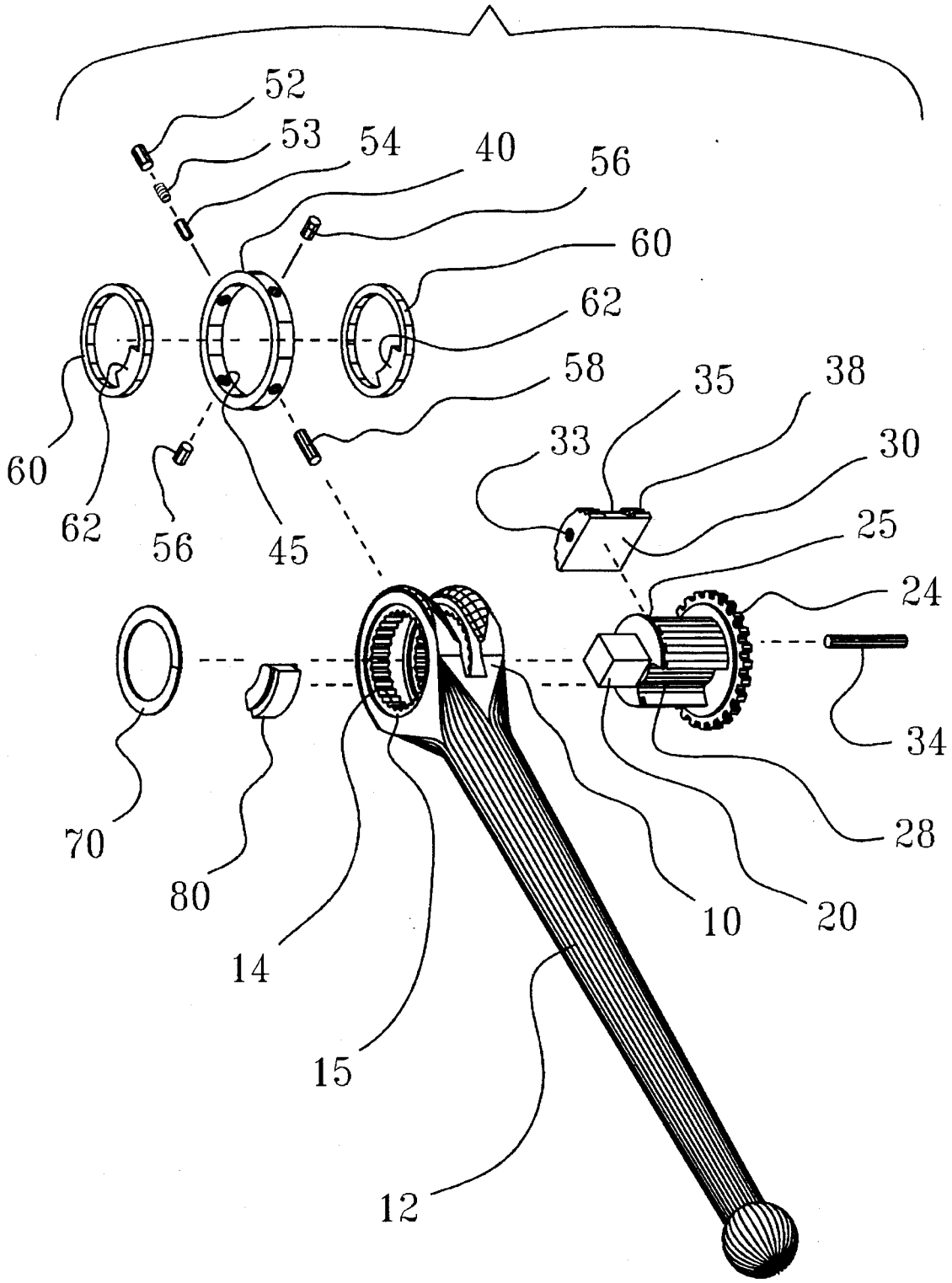
FIG. 3 is an exploded perspective view of the preferred embodiment.

Referring now to FIG. 3, an exploded perspective view is shown of the preferred embodiment. Ratchet head 10, connected to ratchet handle 12, contains internal ratchet teeth 14 arcuately spaced about the ratchet housing rotational axis, and will be engageable with pawl teeth 38. Pawl 30 will pivot about pawl shaft hole 33. Pawl shaft 34 will be pressed into the drive member, and will loosely fit with the pawl such that the pawl will be free to pivot. The optionally knurled drive disk 24 is integral with the drive member. Drive key race 28, consisting of first and second opposed circumferential surfaces, serve in one instance as drive key antifriction ring rotational stops, and is dimensioned to be a relatively close fit to the antifriction ring key 62 of the antifriction ring(s) 60. It may be noted that the antifriction rings need not protrude into the drive key race in a fit to fit basis, but rather may protrude into the drive race such that the relative range of rotation of the antifriction rings is at some value less than the rotational angular span necessary of the control ring relative to the drive to cause pawl reversal. Keep in mind that one purpose of the antifriction rings is to frictionally isolate the control ring from the housing, and the antifriction rings may be allowed to rotate relative to the drive, as long as they do not frictionally drag the control ring a sufficient rotational angle as to cause the pawl to be shifted. It may also be noted that the drive member may alternatively have a protrusion coinciding with a notch in both the antifriction rings and the control ring in order to accomplish the same functional result, in which case a drive race need not exist. Continuing now, the control ring 40 is shown with four circular peg holes 45, all of the same diameter. Pawl shift spring 53 will fit inside pawl shift peg 54. Pawl shift peg 54 shall have a wearable surface in sliding contact with pawl peg race 35. This sliding contact would occur whenever the pawl is shifted, or the ratchet is reversed in direction. Although the embodiments illustrated depict an arcuate region of the pawl where such sliding occurs, it would be possible to incorporate detents in a similar region of the pawl, or even to secure the spring to the pawl and have it exert force in sliding contact with the control ring (with or without control ring detents) in order to accomplish the same result. Continuing now, pawl shift peg outer cylinder 52 will be pressed into one of the peg holes 45, and will slidably receive pawl shift peg 54 such that the pawl shift peg 54 will always maintain contact with pawl peg race 35. Shift range stop peg 58 is pressed into another one of the peg holes 45, and is to protrude into drive key race 28, and limit the range of rotation between the control ring 40 and drive member. As indicated above, this range of rotation is sufficient only to shift the pawl 30 to either ratcheting direction. Spacer peg(s) 56 are present simply to ensure the antifriction rings are properly positioned during their installed, spaced apart relationship. The shift peg out cylinder, shift range stop peg, and the spacer pegs may alternatively be threaded into the control ring rather that pressed. During the final stage of assembly, plug 80, molded of synthetic material, may optionally be installed to prevent dirt or other foreign substances from entering the mechanism, and upon assembly is captured on all sides between the drive key race sides, one of the antifriction ring keys, and the retaining clip 70. The assembly retaining clip 70 will seat between the drive retaining ring groove 25 and the ratchet head circumferential retaining ring groove 15.

Figure 4:
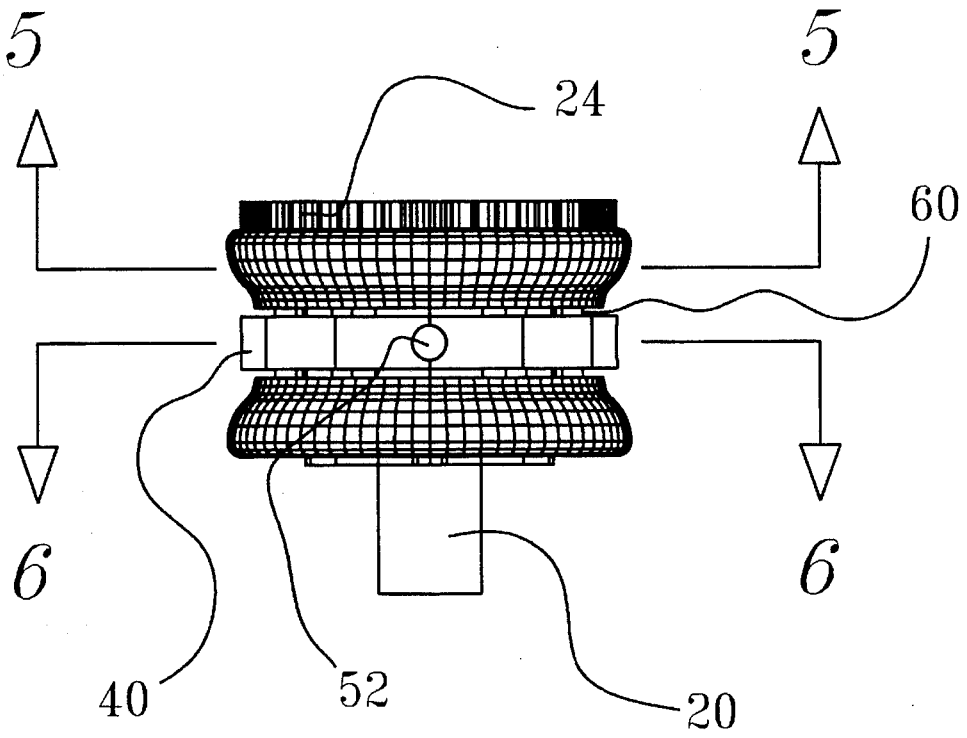
FIG. 4 is an end view of the preferred embodiment showing where cross sections will be taken at 5—5, and 6—6.

Direction attention now to FIG. 4, an end view is shown of the preferred embodiment. The optionally knurled drive disk 24 projects beyond the ratchet head a sufficient distance to enable the operator to readily rotate the square drive 20 by hand when torque conditions permit. Control ring 40 is centered within the ratchet head by a pair antifriction rings 60 making opposed contact with the spacer pegs, shift range stop peg, and pawl shift peg outer cylinder 52.

Figure 5:
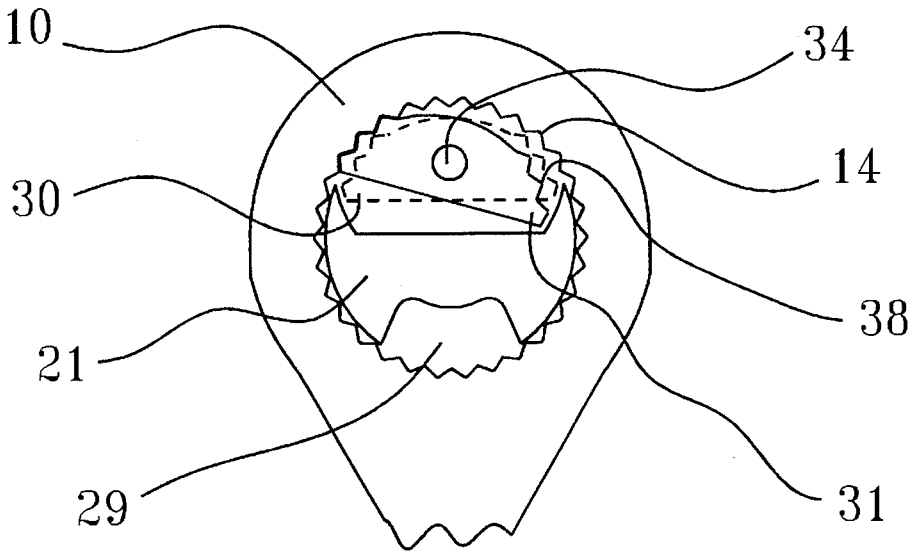
FIG. 5 is a cross sectional view taken at 5—5 of FIG. 4.

Continuing now with FIG. 5, a cross section of the ratchet head 10 taken at section line 5—5 of FIG. 4 is illustrated with pawl 30 as dashed lines in the neutral position, and with engaged pawl 31 as solid lines. The pawl shaft 34 fits loosely with the pawl to allow the pawl to pivot. The pawl teeth 38 of engaged pawl 31 may be considered engaged with ratchet teeth 14 such that the ratchet handle will rotate the drive cross section 21 clockwise. The drive key race 28 does not serve any function at this cross section, and is shown as a simple void. During the manufacturing of the drive, the portion of the drive key race between the drive disk and the nearest antifriction ring need not be machined or cast out.

Figure 6:
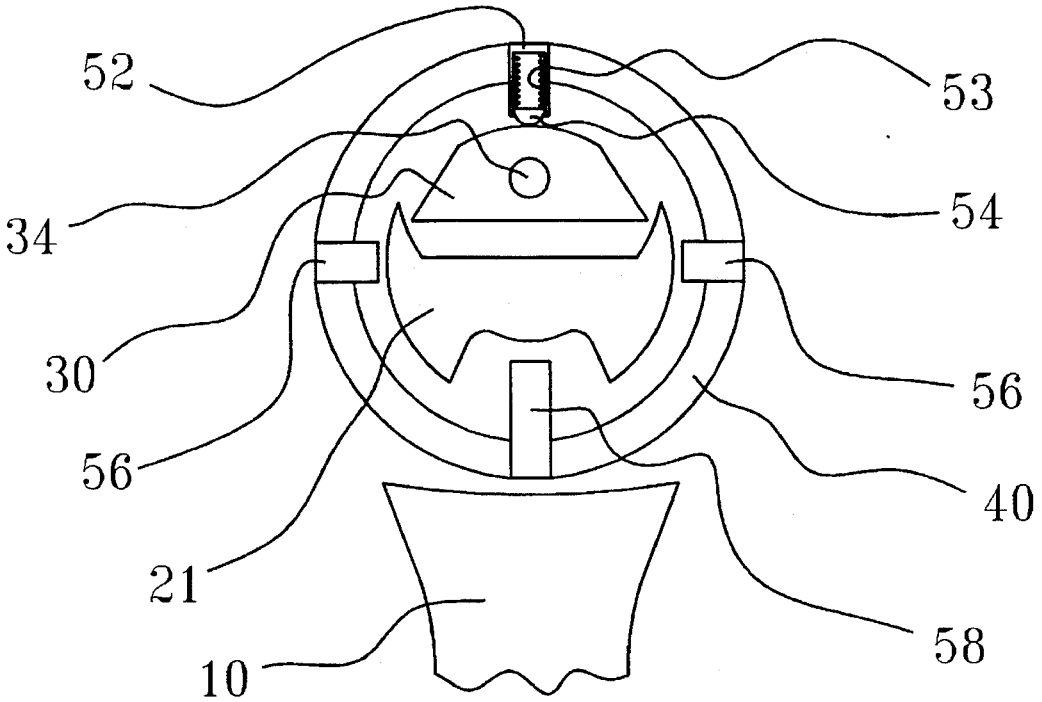
FIG. 6 is a cross sectional view taken at 6—6 of FIG. 4.

Referring now to FIG. 6, cross section 6—6 of FIG. 4 is shown which illustrates a cross section of the control ring 40 as it would appear when the pawl 30 has pivoted to the intermediate (neutral) position during ratchet reversal. Material has been removed from ratchet head 10 to allow insertion of the control ring. Shift range stop peg 58, pawl shift peg outer cylinder 52 which receives pawl shift peg 54, and the pair of diametrically opposed spacer pegs 56 all protrude radially inward while spacing apart the antifriction rings. Pawl shift spring 53 is positioned inside pawl shift peg 54, and biases the pawl shift peg against the pawl at all times. Drive cross section 21 is integral with both the square drive, and the drive disk.

Figure 7:
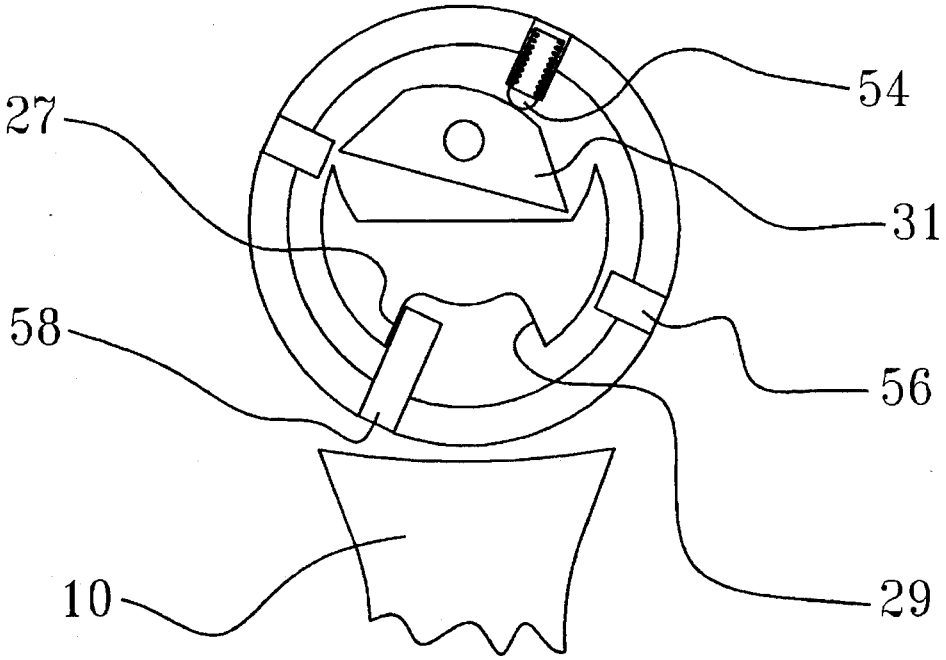
FIG. 7 is a cross sectional view taken at the same cross section as FIG. 6, but shows the wrench during clockwise torque application.

Directing attention now to FIG. 7, another cross section taken at section line 6—6 of FIG. 4 is shown, however the control ring has been rotated to cause the pawl shift peg 54 to orientate the engaged pawl 31 such that ratcheting in the clockwise direction is possible. Thee relative range to which the pawl shift peg is allowed to span is limited by the distance the shift range stop peg 58 is allowed to travel within the drive key race. In the relative position shown in FIG. 7, the shift range stop peg 58 has abutted against a first circumferentially opposed drive key race surface 27 to a control ring first position, thus enabling clockwise rotation. Shift range stop peg 58 abuts a second circumferentially opposed drive key race surface 29 to a control ring second position during counter clockwise rotation. The author/inventor's reference frame here is that clockwise rotation generally threads fasteners and the like on, or to the installed direction. Ratchet head 10, and spacer pegs 56 complete the description of this figure.

Figure 8:
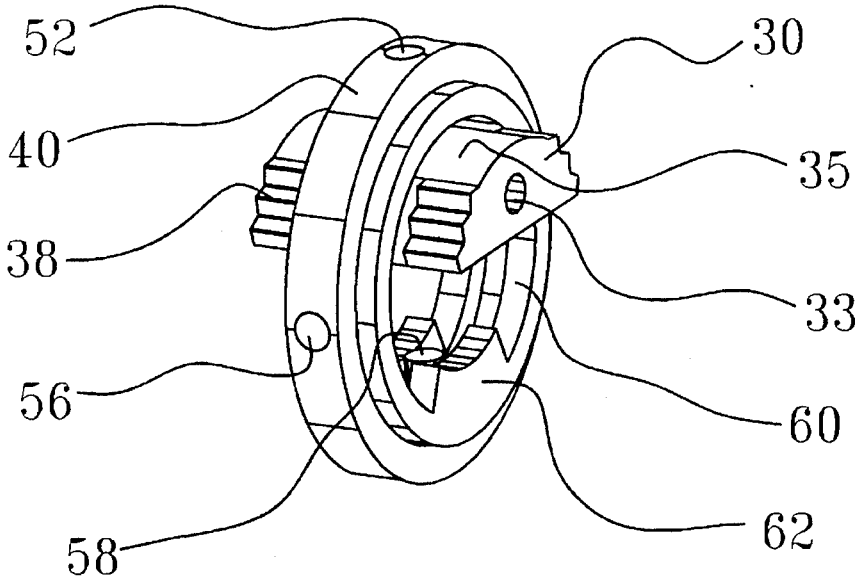
FIG. 8 is a perspective view of the interior core of the mechanism used in the preferred embodiment.

Referring now to FIG. 8, a perspective view is shown of the interior core of the mechanism. The control ring 40 will rotate about the rotational axis of the drive. During final assembly, pawl shift peg outer cylinder 52, spacer peg(s) 56, and shift range stop peg 58 will be positioned between the two antifriction rings 60 to cause the rings to be separated, and therefore to center the core in its operatable position. During operation, pawl shaft hole 33 will rotationally surround the pawl shaft, said pawl shaft being fixed to the drive, in order to allow the pawl 30 to pivot to a first or second pawl position upon application of force on either side of the pawl pivot point as the pawl shift peg moves circumferentially along the pawl peg race 35. External pawl teeth 38 will become in ratcheting engagement with the internal teeth of the ratchet head during tool operation. Each antifriction ring has an antifriction ring key 62 which may be engaged with minimal clearance into the drive key race. Upon close examination of the figure, the shift range stop peg, and therefore the pawl shift peg, is limited in its range of motion to only allow the pawl to shift in either direction. After the pawl has shifted, the shift range stop peg will abut against a side of the drive key race or drive key circumferentially opposed surface, therefore allowing the drive to be directly rotated if the control ring is continually turned. It may be noted that the control ring 40, as well as the antifriction rings 60, may be fabricated from metal or plastic.

Figure 9:
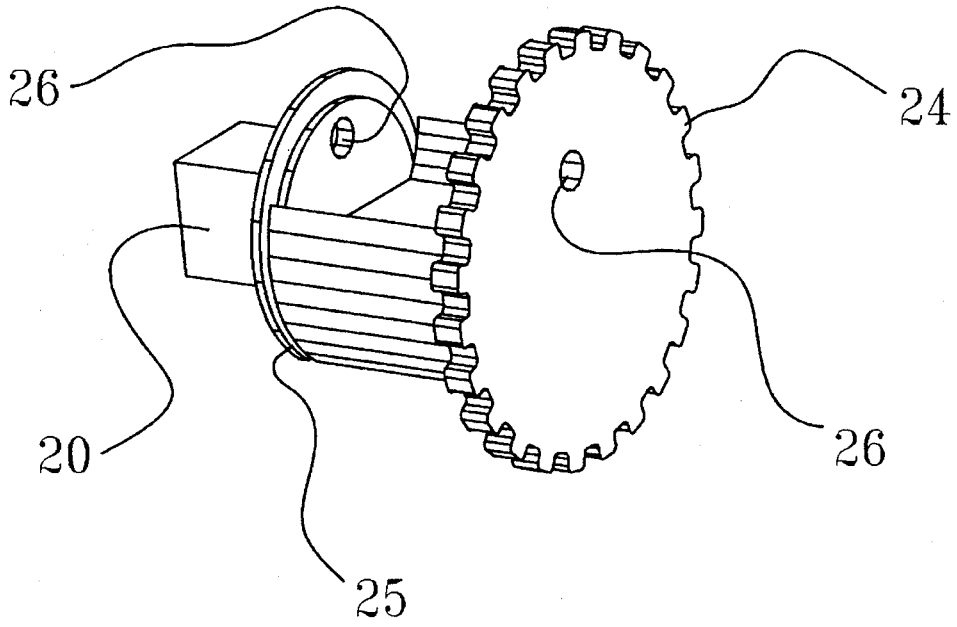
FIG. 9 is a perspective view of the drive member of the preferred embodiment.

Continuing now with FIG. 9, the drive member is shown separately in a perspective view. The pawl shaft will be pressed into the drive pawl shaft hole 26, which extends longitudinally completely through the drive member, and is parallel to the drive members rotational axis. The knurled drive disk 24 may be roughly contoured at its circumference in order to aid during digitally actuated rotational force. Square drive 20 is machined integrally out of the same block of metal as the rest of the drive member. The drive retaining ring groove 25 will prevent the drive member from withdrawing from the ratchet housing, after the retaining ring is seated.

Figure 10:
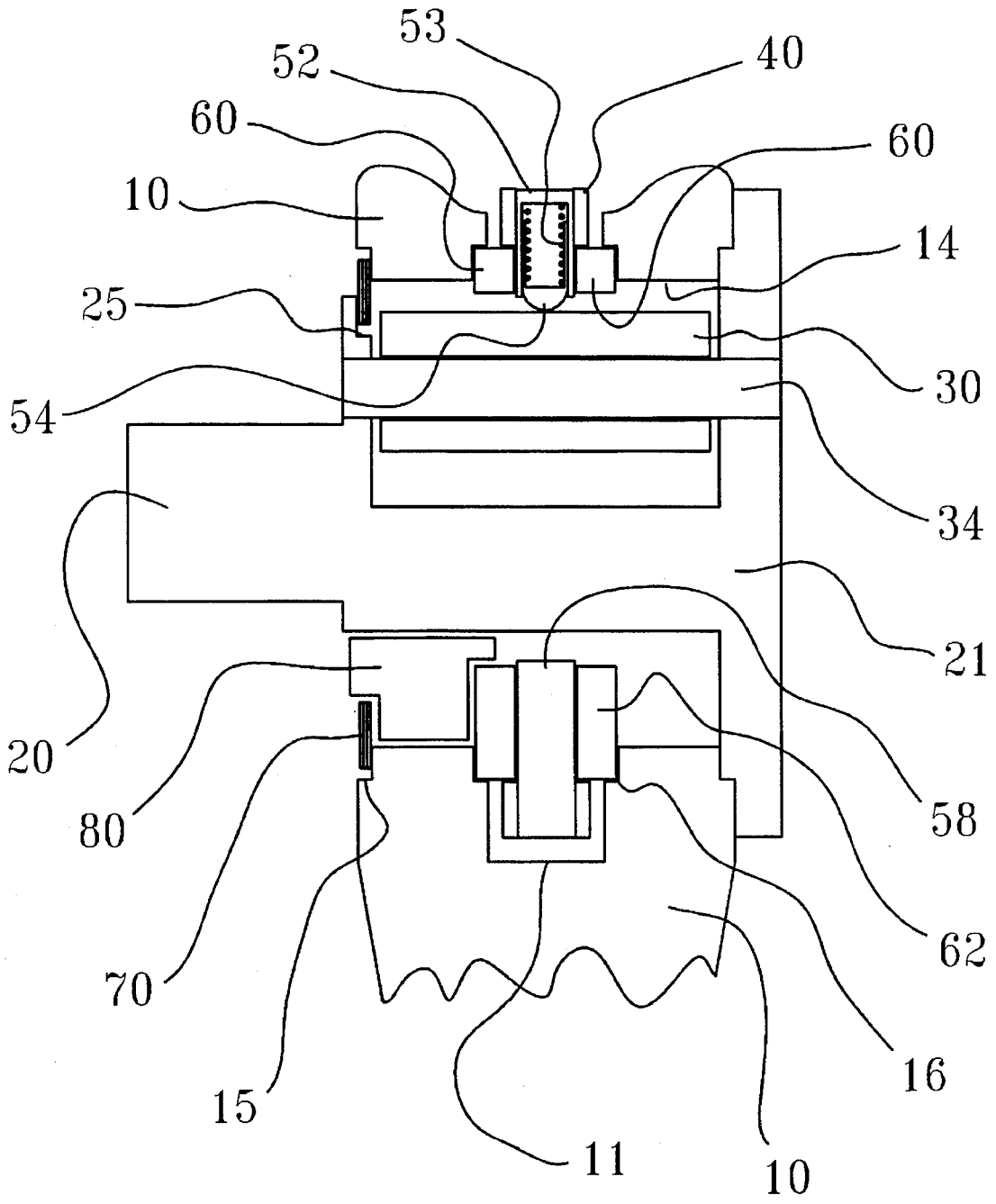
FIG. 10 is a side cross sectional view of the preferred embodiment taken about a central plane.

Directing attention now to FIG. 10, a side cross sectional view is shown of the preferred embodiment taken about a vertical central plane. Ratchet head 10 has internal teeth 14, all of which are aligned throughout the full depth of the ratchet head. Drive cross section 21 is seen to extend to square drive 20, and secures pawl shaft 34 to allow pawl 30 to pivot as control ring 40 is reversibly rotated. Pawl shaft peg 54 is spring biased against the pawl 30 at all times by pawl shift spring 53. Pawl shift peg outer cylinder 52 is pressed into the control ring 40, and slidably receives pawl shift peg 54, and also will assist in the parallel separation of the antifriction rings 60. Shift range stop peg 58 is also pressed into the control ring and will assist in the parallel separation of the antifriction rings at the antifriction ring key 62. The antifriction rings 60 will be circumferentially and rotatably contained, upon separation, into ratchet head circumferential antifriction ring groove 16. This groove may be machined before Or after machining the ratchet head control ring groove bottom 11. Upon assembly, plug 80 is captured after assembly retaining clip 70 is installed. Assembly retaining clip 70 will prevent withdrawal of the drive member due to interposition of the retaining clip between the drive retaining ring groove 25 and the ratchet head circumferential retaining groove 15.

Having described in detail the elements of the preferred embodiment, and before moving on to describe alternative embodiments, the order in which this mechanism may be assembled will now be generally explained. For this procedure, the reader may find it useful to refer to FIG. 3.

Beginning with the drive assembly, pawl 30 shall be placed into position within the drive member, followed by pressing the pawl shaft 34 into the drive pawl shaft hole. Now, stack the two antifriction rings 60 together, and insert them into the interior diameter of the control ring 40, and position the control ring with its two antifriction rings into the central slot of the ratchet head such that the rotation axis of the control ring will be coaxial with the rotational axis of the ratchet head. By design, the total thickness of the two stacked antifriction rings is equal to the thickness of the control ring. Now separate the two antifriction rings 60 such that they will seat within the ratchet head circumferential antifriction ring groove 16 (identified only in FIG. 10), and install, by pressing into the control ring, the pawl shift peg outer cylinder 52, the shift range stop peg 58, and the two spacer pegs 56. The control ring 40 and the antifriction rings 60 are now trapped within their operatable position. Now insert the pawl shift spring 53 into the pawl shift peg 54, and then, by working within the ratchet head, install the pawl shift peg 54 into the pawl shift peg outer cylinder 52. Compress the spring loaded pawl shift peg 54 by applying force radially outward, and insert the drive assembly into position within the ratchet head while allowing the pawl shift peg 54 to slide onto the pawl peg race 35. The drive key race must of course be aligned with the antifriction ring keys and the control ring shift range stop peg prior to drive insertion. At this point, the optional plug 80 may be inserted, followed by installation of the assembly retaining clip 70. Disassembly is the reverse of the above procedure, except that if the control ring needs to also be removed, it would be easiest to punch the pawl shift peg outer cylinder 52, the shift range stop peg 58, and the spacer pegs 56 radially inward, prior to juxtapositioning the antifriction rings 60 and withdrawing the control ring.

Figure 11:
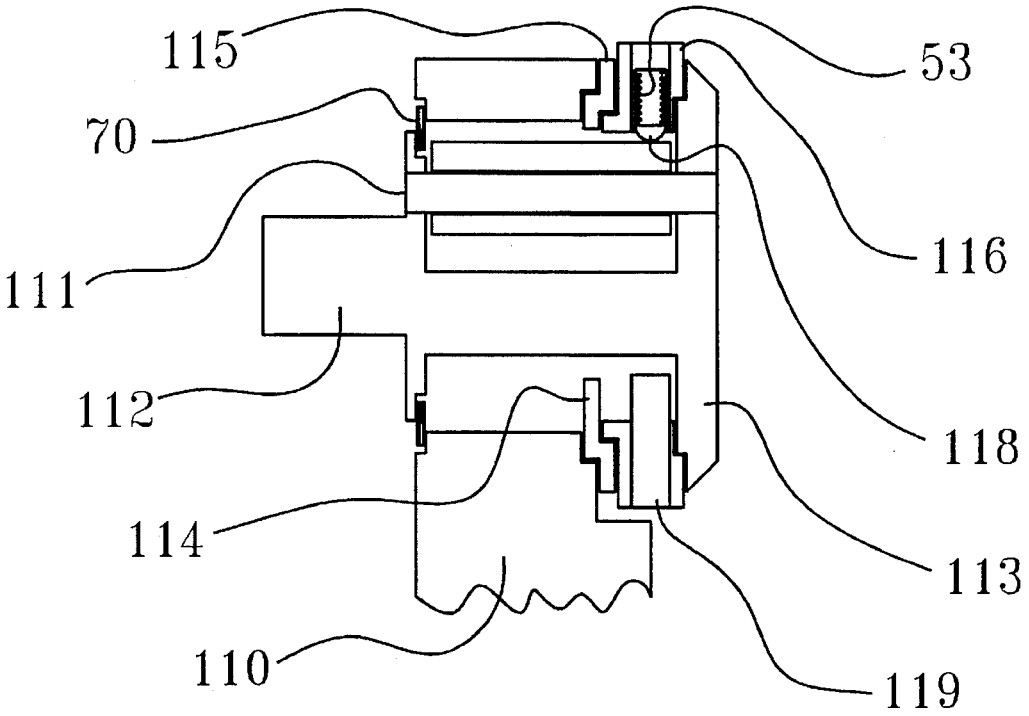
FIG. 11 is a side cross sectional view of an embodiment which locates the control ring at a position opposite the drive end.

Continuing now with the detailed description of the remaining two figures, FIG. 11 illustrates the second embodiment which locates a top control version control ring 116 at the operator side of the top control version ratchet housing 110, juxtaposed to the top control version drive disk 113. The top control version square drive 112 is integral with the drive member. The drive member has a drive key race similar to the preferred embodiment, into which the top control version shift range stop peg 119 and top control version antifriction ring key 114 is positioned. The pawl is shifted about the top control version pawl shaft 111 upon rotational reversal of the top control version control ring 116, thereby repositioning the top control version pawl shift peg 118, as biased against the pawl by pawl shift spring 53; to an opposite pivot side of the pawl. The top control ring version antifriction ring 115 is of a staggered profile, and is nested between the top control version ratchet housing 110 and the top control version control ring 116. Installation of the assembly retaining clip 70 maintains the drive member in the operable position.

Figure 12:
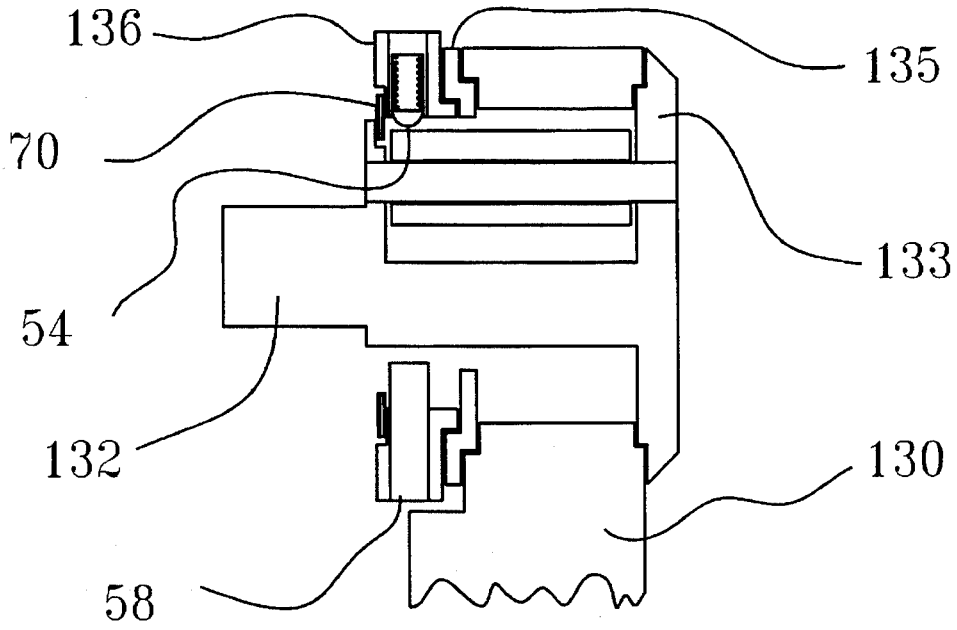
FIG. 12 is a side cross sectional view of an embodiment which locates the control ring at a position adjacent to the drive end.

Referring finally now to FIG. 12, a third embodiment is illustrated in which a bottom control version ratchet housing 130 features a bottom control version control ring 136 adjacent to the bottom control version square drive 132. The bottom control version drive disk 133 is accessible at the top, toward the operator. Bottom control version antifriction ring 135 staggers to an opposite direction to the antifriction ring shown in FIG. 11. Pawl shift peg 54, shift range stop peg 58, and assembly retaining clip 70 are identical, and serve the same functions as their counterpart in the other embodiments. Although three separate placement locations of the control ring are illustrated, it is also possible to design this ratchet with other configurations such as where the drive disk is either not present or is adjacent to the drive, and the control ring is located at each of three locations: adjacent to the drive, at the center of the housing, or at the longitudinal end of the housing opposite the drive.

Thus, an improved ratchet wrench has been shown which greatly improves upon ergonomics of operation. The invention is applicable to the design and manufacture of new ratchet wrenches and to previously designed or existing ratchet wrenches. The invention is also applicable for other ratcheting tools such as those used for winching, bolt or pipe threading, or even automotive or industrial ratcheting jacks and the like.

While preferred embodiments of the invention have been shown and described, it will be apparent to those skilled in the art that changes and modifications can be made in these embodiments without departing from the principals and spirit of the invention, the scope of which is defined in the appended claims.

I claim:

1. A ratcheting mechanism comprising:

(a) a ratchet housing, (b) a ratchet housing rotational axis, (c) a drive member extending into a portion of said ratchet housing, (d) a drive member rotational axis, (e) said drive member rotatably installed to said ratchet housing wherein said drive member rotational axis is coaxial with said ratchet housing rotational axis, (f) a pawl mounted rotatably to said drive member, (g) said pawl having a rotational axis parallel to said drive member rotational axis, (h) a plurality of ratchet housing internal teeth arcuately spaced about said ratchet housing rotational axis, (i) said pawl member having oppositely disposed first and second toothed portions which will engage with said internal teeth of said ratchet housing when said pawl is caused to rotate to a first position or caused to rotate to a second position, (j) a control ring surrounding said drive member, (k) said control ring having a rotational axis, (l) said rotational axis of said control ring being coaxial with said rotational axis of said drive member, (m) a control ring first and second shift range stop means whereby said control ring may be rotated to a first direction relative to said drive in order to shift the pawl to a first position, and after the pawl has shifted, the first stop means will prevent the control ring from further rotation in the first direction relative to the drive, and also whereby said control ring may be rotated a second direction relative to said drive to shift the pawl to a second position, and after the pawl has shifted, the second stop means will prevent the control ring from further rotation in the second direction relative to the drive, and whereby rotating the control ring to the first direction to the first stop means orientates the control ring to a first position relative to the drive, and by rotating the control ring to the second direction to the second stop means orientates the control ring to a second position relative to the drive, wherein the relative rotational angular span between said first control ring position and said second control ring position comprises a control ring rotational range.

2. The apparatus of claim 1, further comprising:

(a) a pawl shift spring circumferentially secured to said control ring wherein said pawl shift spring exerts force radially inward toward said pawl, (b) a drive key race consisting of a cavity in said drive member extending radially toward said drive rotational axis, (c) said cavity in said drive member consisting of a first and second circumferentially opposed drive key race surface, (d) wherein said control ring shift range stop means consists of a shift range stop element secured to said control ring and radially protruding into a portion of said drive key race, said shift range stop element to abut against first opposed drive key race surface of said circumferentially opposed drive key race surfaces when said control ring is in said first control ring position, and said shift range stop element to abut against second opposed drive key race surface of said circumferentially opposed drive key race surfaces when said control ring is in said second control ring position, wherein said abutment of said shift range stop peg against said first opposed drive key race surface permits the operator to cause ratcheting rotation of the drive member upon rotation of the control ring in said first direction, and said abutment of said shift range stop peg against said second opposed drive key race surface permits the operator to cause ratcheting rotation of the drive member upon rotation of the control ring in said second direction.

3. The apparatus of claim 2, further comprising:

(a) an antifriction ring having surfaces frictionally interposed between said control ring and said ratchet housing, (b) means to prevent said antifriction ring from rotating relative to said drive to a magnitude greater than said control ring rotational range, (c) a portion of the antifriction ring protruding into a portion of said drive key race.

4. The apparatus of claim 3, further comprising:

(a) a ratchet housing slot established in the ratchet head perpendicular to the drive rotational axis, and intersecting said arcuately spaced ratchet housing internal teeth, (b) said control ring positioned within said ratchet housing slot, (c) said control ring having an inner circumferential surface, (d) one or more spacer elements secured to said control ring and extending radially inward beyond said control ring inner circumferential surface, (e) a pair of antifriction rings in opposed contact with said spacer elements, and positioned radially within said control ring.

5. The apparatus of claim 4, further comprising:

(a) a square drive end attached to said drive member for receiving interchangeable sockets and the like, (b) said square drive end further comprising a socket retention device consisting of a ball which is spring loaded and slidably mounted within one face of said square drive end, (d) a handle attached to said ratchet housing.

6. The apparatus of claim 5, wherein said socket retention device being of a quick release type with push button release.

7. The apparatus of claim 5, wherein the control ring is installed at the longitudinal end of the ratchet housing corresponding to the drive end.

8. The apparatus of claim 5, wherein the control ring is installed at the longitudinal end of the ratchet housing opposite the drive end.

9. A ratcheting mechanism comprising:

(a) a ratchet housing, (b) a ratchet housing rotational axis, (c) a drive member extending into a portion of said ratchet housing, (d) a drive member rotational axis, (e) said drive member rotatably installed to said ratchet housing wherein said drive member rotational axis is coaxial with said ratchet housing rotational axis, (f) a pawl mounted rotatably to said drive member, (g) said pawl having a rotational axis parallel to said drive member rotational axis, (h) a plurality of ratchet housing internal teeth arcuately spaced about said ratchet housing rotational axis, (i) said pawl member having oppositely disposed first and second toothed portions which will engage with said internal teeth of said ratchet housing when said pawl is caused to rotate to a first position or caused to rotate to a second position, (j) a control ring surrounding said drive member, (k) said control ring having a rotational axis, (l) said rotational axis of said control ring being coaxial with said rotational axis of said drive member, (m) a pawl shift spring circumferentially secured to said control ring wherein said pawl shift spring exerts force radially inward toward said pawl, (n) a drive key race consisting of a cavity in said drive member extending radially toward said drive rotational axis, (o) said cavity in said drive member consisting of a first and second circumferentially opposed drive key race surface, (p) a shift range stop element secured to said control ring and radially protruding into a portion of said drive key race, said shift range stop element to abut against first opposed drive key race surface of said circumferentially opposed drive key race surfaces when said control ring is in said first control ring position, and said shift range stop element to abut against second opposed drive key race surface of said circumferentially opposed drive key race surfaces when said control ring is in said second control ring position, wherein said abutment of said shift range stop peg against said first opposed drive key race surface permits the operator to cause ratcheting rotation of the drive member upon rotation of the control ring in said first direction, and said abutment of said shift range stop peg against said second opposed drive key race surface permits the operator to cause ratcheting rotation of the drive member upon rotation of the control ring in said second direction.

10. The apparatus of claim 9, further comprising:

(a) an antifriction ring having surfaces frictionally interposed between said control ring and said ratchet housing, (b) a portion of the antifriction ring protruding into a portion of said drive key race.

11. The apparatus of claim 10, further comprising:

(a) a ratchet housing slot established in the ratchet head perpendicular to the drive rotational axis, and intersecting said arcuately spaced ratchet housing internal teeth, (b) said control ring positioned within said ratchet housing slot, (c) said control ring having an inner circumferential surface, (d) one or more spacer elements secured to said control ring and extending radially inward beyond said control ring inner circumferential surface, (e) a pair of antifriction rings in opposed contact with said spacer pegs, and positioned radially within said control ring.

12. The apparatus of claim 10, wherein the control ring is installed at the longitudinal end of the ratchet housing corresponding to the drive end.

13. The apparatus of claim 10, wherein the control ring is installed at the longitudinal end of the ratchet housing opposite the drive end.

14. The apparatus of claim 10, further comprising:

(a) a square drive end attached to said drive member for receiving interchangeable sockets and the like, (b) said square drive end further characterized as including a socket retention device consisting of a ball which is spring loaded and slidably mounted within one face of said square drive end, (c) said socket retention device being of a quick release type with push button release, (d) a handle attached to said ratchet housing.

15. A ratcheting mechanism comprising:

(a) a ratchet housing, (b) a ratchet housing rotational axis, (c) a drive member extending into a portion of said ratchet housing, (d) a drive member rotational axis, (e) said drive member rotatably installed to said ratchet housing wherein said drive member rotational axis is coaxial with said ratchet housing rotational axis, (f) a pawl mounted rotatably to said drive member, (g) said pawl having a rotational axis parallel to said drive member rotational axis, (h) a plurality of ratchet housing internal teeth arcuately spaced about said ratchet housing rotational axis, (i) said pawl member having oppositely disposed first and second toothed portions which will engage with said internal teeth of said ratchet housing when said pawl is caused to rotate to a first position or caused to rotate to a second position, (j) a control ring surrounding said drive member, (k) said control ring having a rotational axis, (l) said rotational axis of said control ring being coaxial with said rotational axis of said drive member, (m) a pawl shift spring circumferentially secured to said control ring wherein said pawl shift spring exerts force radially inward toward said pawl, (n) a drive key race consisting of a cavity in said drive member extending radially toward said drive rotational axis, (o) said cavity in said drive member consisting of a first and second circumferentially opposed drive key race surface, (p) a shift range stop element secured to said control ring and radially protruding into a portion of said drive key race, said shift range stop element to abut against first opposed drive key race surface of said circumferentially opposed drive key race surfaces when said control ring is in said first control ring position, and said shift range stop element to abut against second opposed drive key race surface of said circumferentially opposed drive key race surfaces when said control ring is in said second control ring position, wherein said abutment of said shift range stop peg against said first opposed drive key race surface permits the operator to cause ratcheting rotation of the drive member upon rotation of the control ring in said first direction, and said abutment of said shift range stop peg against said second opposed drive key race surface permits the operator to cause ratcheting rotation of the drive member upon rotation of the control ring in said second direction, (q) an antifriction ring having surfaces frictionally interposed between said control ring and said ratchet housing, (r) a portion of the antifriction ring protruding into a portion of said drive key race, (s) a ratchet housing slot established in the ratchet head perpendicular to the drive rotational axis, and intersecting said arcuately spaced ratchet housing internal teeth at an approximate longitudinal central region of the ratchet head, (t) said control ring positioned within said ratchet housing slot, (u) said control ring having an inner circumferential surface, (v) a pair of antifriction rings in opposed contact with said spacer pegs, and positioned radially within said control ring.

16. The apparatus of claim 15, further comprising:

(a) a square drive end attached to said drive member for receiving interchangeable sockets and the like.

17. The apparatus of claim 15 wherein said square drive end includes a socket retention device consisting of a ball slidably mounted in a face of said drive and means provided such that said ball exerts force against interchangeable sockets and the like.

18. The apparatus of claim 15 wherein:

(a) said socket retention device is of the popular style employing a cammed ball and a quick release button, (d) a handle attached to said ratchet housing.

* * * * *